US008834679B2

(12) United States Patent
Kim et al.

(10) Patent No.: US 8,834,679 B2
(45) Date of Patent: Sep. 16, 2014

(54) SOFT TISSUE HAVING REDUCED HYDROGEN BONDING

(71) Applicant: Kimberly-Clark Worldwide, Inc., Neenah, WI (US)

(72) Inventors: JeongKyung Kim, Gyeonggi-do (KR); SeungRim Yang, Gyeonggi-do (KR); Jian Qin, Appleton, WI (US); Deborah Joy Calewarts, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 13/726,904

(22) Filed: Dec. 26, 2012

(65) Prior Publication Data

US 2014/0178660 A1 Jun. 26, 2014

(51) Int. Cl.

| | |
|---|---|
| ***D21H 21/22*** | (2006.01) |
| ***D21H 17/07*** | (2006.01) |
| ***D21H 17/11*** | (2006.01) |
| ***D21H 23/04*** | (2006.01) |
| ***D21H 23/76*** | (2006.01) |
| ***D21C 1/06*** | (2006.01) |

(52) U.S. Cl.

CPC ..... *D21C 1/06* (2013.01); *D21H 21/22* (2013.01); *D21H 17/07* (2013.01); *D21H 23/04* (2013.01); *D21H 17/11* (2013.01); *D21H 23/76* (2013.01)

USPC ..... 162/164.6; 163/74; 163/182; 163/183; 163/185

(58) Field of Classification Search

CPC ..... D21H 17/11; D21H 17/07; D21H 17/64; D21H 11/20; D21H 11/16; D21H 21/22; D21H 23/04; D21H 23/76; D21H 27/002; D21H 27/004; D21H 27/005; A47K 10/16; B32B 2262/065; B32B 2262/067; B32B 2555/00; B32B 2555/02

USPC ..... 162/9, 72, 74, 158, 164.6, 168.5, 185, 162/187, 182, 183; 8/190, 919

See application file for complete search history.

(56) References Cited

U.S. PATENT DOCUMENTS

| | | | | | |
|---|---|---|---|---|---|
| 2,306,440 | A | * | 12/1942 | Hentrich et al. | 106/169.1 |
| 2,524,399 | A | | 10/1950 | Schoene et al. | |
| 2,892,674 | A | * | 6/1959 | Sause et al. | 8/190 |
| 3,124,414 | A | * | 3/1964 | Dolmetsch | 8/190 |
| 3,240,797 | A | | 3/1966 | Gale | |
| 3,961,892 | A | | 6/1976 | Bishop et al. | |
| 4,035,146 | A | * | 7/1977 | Brenner et al. | 8/94.21 |
| 4,186,238 | A | * | 1/1980 | Holst et al. | 428/326 |

(Continued)

FOREIGN PATENT DOCUMENTS

| | | | |
|---|---|---|---|
| WO | WO 99/36620 | A1 | 7/1999 |
| WO | WO 01/23660 | A1 | 4/2001 |
| WO | WO 2005/123699 | A1 | 12/2005 |

*Primary Examiner* — Eric Hug

(74) *Attorney, Agent, or Firm* — Kimberly-Clark Worldwide, Inc.

(57) ABSTRACT

The present invention provides a modified cellulosic fiber having reduced hydrogen bonding capabilities. The modified fiber formed in accordance with the present invention may be useful in the production of tissue products having improved bulk and softness. More importantly, the modified fiber is adaptable to current tissue making processes and may be incorporated into a tissue product to improve bulk and softness without an unsatisfactory reduction in tensile.

9 Claims, 3 Drawing Sheets

(56) References Cited

U.S. PATENT DOCUMENTS

| | | | | |
|---|---|---|---|---|
| 4,372,815 | A * | 2/1983 | Newkirk et al. | 162/158 |
| 4,549,011 | A * | 10/1985 | Herzberg et al. | 536/31 |
| 5,882,356 | A | 3/1999 | Potter | |
| 5,935,383 | A | 8/1999 | Sun et al. | |
| 6,036,731 | A | 3/2000 | Scheibli et al. | |
| 7,867,361 | B2 * | 1/2011 | Salaam et al. | 162/123 |
| 8,177,859 | B2 | 5/2012 | Schmidt et al. | |
| 2002/0037410 | A1 | 3/2002 | Criegee et al. | |

* cited by examiner

Control (X100)

Cyanuric Chloride 2% treated (X100)

SOFT TISSUE HAVING REDUCED HYDROGEN BONDING

BACKGROUND

In the manufacture of paper products, such as facial tissue, bath tissue, paper towels, dinner napkins, and the like, a wide variety of product properties are imparted to the final product through the use of chemical additives applied in the wet end of the tissue making process. Two of the most important attributes imparted to tissue through the use of wet end chemical additives are strength and softness. Specifically for softness, a chemical debonding agent is normally used. Such debonding agents are typically quaternary ammonium compounds containing long chain alkyl groups. The cationic quaternary ammonium entity allows for the material to be retained on the cellulose via ionic bonding to anionic groups on the cellulose fibers. The long chain alkyl groups provide softness to the tissue sheet by disrupting fiber-to-fiber hydrogen bonds in the sheet. The use of such debonding agents is broadly taught in the art. Such disruption of fiber-to-fiber bonds provides a two-fold purpose in increasing the softness of the tissue. First, the reduction in hydrogen bonding produces a reduction in tensile strength thereby reducing the stiffness of the sheet. Secondly, the debonded fibers provide a surface nap to the tissue web enhancing the "fuzziness" of the tissue sheet. This sheet fuzziness may also be created through use of creping as well, where sufficient interfiber bonds are broken at the outer tissue surface to provide a plethora of free fiber ends on the tissue surface. Both debonding and creping increase levels of lint and slough in the product. Indeed, while softness increases, it is at the expense of an increase in lint and slough in the tissue relative to an untreated control. It can also be shown that in a blended (non-layered) sheet that the level of lint and slough is inversely proportional to the tensile strength of the sheet. Lint and slough can generally be defined as the tendency of the fibers in the paper web to be rubbed from the web when handled.

It is also broadly known in the art to use a multi-layered tissue structure to enhance the softness of the tissue sheet. In this embodiment, a thin layer of strong softwood fibers is used in the center layer to provide the necessary tensile strength for the product. The outer layers of such structures are composed of the shorter hardwood fibers, which may or may not contain a chemical debonder. A disadvantage to using layered structures is that while softness is increased the mechanism for such increase is believed due to an increase in the surface nap of the debonded, shorter fibers. As a consequence, such structures, while showing enhanced softness, do so with a trade-off in the level of lint and slough.

It is also broadly known in the art to concurrently add a chemical strength agent in the wet-end to counteract the negative effects of the debonding agents. In a blended sheet, the addition of such agents reduces lint and slough levels. However, such reduction is done at the expense of surface feel and overall softness and becomes primarily a function of sheet tensile strength. In a layered sheet, strength chemicals are added preferentially to the center layer. While this perhaps helps to give a sheet with an improved surface feel at a given tensile strength, such structures actually exhibit higher slough and lint at a given tensile strength, with the level of debonder in the outer layer being directly proportional to the increase in lint and slough.

There are additional disadvantages with using separate strength and softness chemical additives. Particularly relevant to lint and slough generation is the manner in which the softness additives distribute themselves upon the fibers.

Bleached Kraft fibers typically contain only about 2-3 milliequivalents of anionic carboxyl groups per 100 grams of fiber. When the cationic debonder is added to the fibers, even in a perfectly mixed system where the debonder will distribute in a true normal distribution, some portion of the fibers will be completely debonded. These fibers have very little affinity for other fibers in the web and therefore are easily lost from the surface when the web is subjected to an abrading force.

Therefore there is a need for a means of reducing lint and slough in soft tissues while maintaining softness and strength.

SUMMARY

It has now been surprisingly discovered the sheet bulk of a tissue web may be increased, with only minimal degradation in tensile strength, by forming the web with at least a portion of cellulosic fiber that has been reacted with a cyanuric halide. Reacting cellulosic fiber with a halide results in a modified fiber having fewer hydroxyl groups available to participate in hydrogen bonding when the web is formed. The reduced hydrogen bonding results in a bulkier web that is also softer and less stiff.

Accordingly, in one embodiment the present invention provides a method of increasing the bulk of a tissue web comprising reacting cellulosic fiber with a cyanuric halide having general Formula (I) in the presence of an organic solvent:

(I)

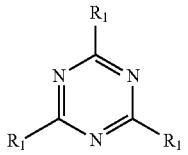

where $R_1$=chlorine, bromine, fluorine or iodine; treating the cellulosic fiber with a caustic agent; washing the cellulosic fiber; and forming a tissue web from the cellulosic fiber, wherein the tissue web has a basis weight greater than about 10 grams per square meter (gsm) and a sheet bulk greater than about 5 cc/g.

In another embodiment the present invention provides a tissue web comprising modified wood pulp fibers having a nitrogen content greater than about 0.2 weight percent, the tissue web having a basis weight from about 10 to about 60 gsm and a sheet bulk greater than about 10 cc/g.

In yet another embodiment the present invention provides a hydraulically entangled nonwoven fabric comprising synthetic fibers modified wood pulp fibers having a nitrogen content greater than about 0.2 weight percent.

Other features and aspects of the present invention are discussed in greater detail below.

DEFINITIONS

Figure 1:
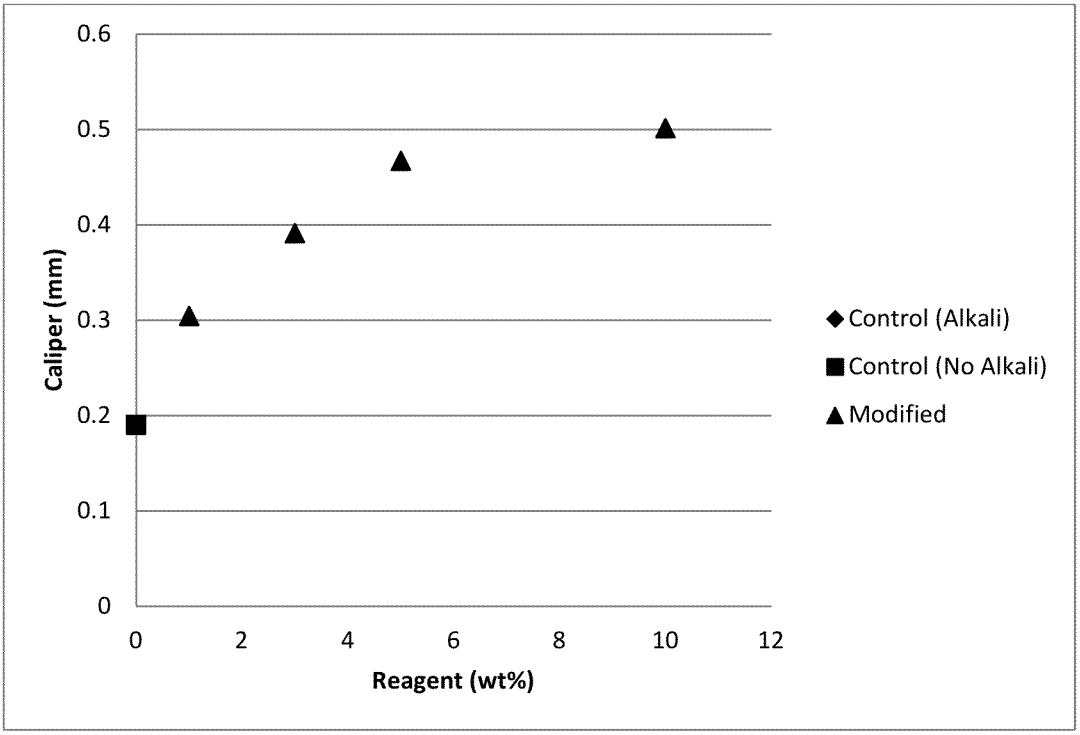
FIG. 1 is a graph of sheet caliper (y-axis) versus reagent mass (x-axis) and illustrates the effect of the amount of reagent and solvent type on the bulk of handsheets comprising modified fiber.

As used herein the term "modified fiber" refers to any cellulosic fibrous material that has been reacted with a cyanuric halogen.

As used herein, the terms "TS7" and "TS7 value" refer to an output of an EMTEC Tissue Softness Analyzer ("TSA") (Emtec Electronic GmbH, Leipzig, Germany) as described in the Test Methods section. The units of the TS7 value are dB $V^2$ rms, however, TS7 values are often referred to herein without reference to units.

As used herein, the terms "TS750" and "TS750 value" refer to another output of the TSA as described in the Test Methods section. The units of the TS750 value are dB $V^2$ rms, however, TS750 values are often referred to herein without reference to units.

As used herein, the term "geometric mean tensile" (GMT) refers to the square root of the product of the machine direction tensile and the cross-machine direction tensile of the web, which are determined as described in the Test Method section.

As used herein, the term "tissue product" refers to products made from tissue webs and includes, bath tissues, facial tissues, paper towels, industrial wipers, foodservice wipers, napkins, medical pads, hydroknit, and other similar products.

As used herein, the terms "tissue web" and "tissue sheet" refer to a fibrous sheet material suitable for use as a tissue product.

As used herein, the term "caliper" is the representative thickness of a single sheet measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board" with Note 3 for stacked sheets. The micrometer used for carrying out T411 om-89 is an Emveco 200-A Tissue Caliper Tester (Emveco, Inc., Newberg, Oreg.). The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second. Caliper may be expressed in mils (0.001 inches) or microns.

As used herein, the term "layer" refers to a plurality of strata of fibers, chemical treatments, or the like, within a ply.

As used herein, the terms "layered tissue web," "multi-layered tissue web," "multi-layered web," and "multi-layered paper sheet," generally refer to sheets of paper prepared from two or more layers of aqueous papermaking furnish which are preferably comprised of different fiber types. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

The term "ply" refers to a discrete product element. Individual plies may be arranged in juxtaposition to each other. The term may refer to a plurality of web-like components such as in a multi-ply facial tissue, bath tissue, paper towel, wipe, or napkin.

DETAILED DESCRIPTION

The present invention provides a modified cellulosic fiber having reduced hydrogen bonding capabilities. The modified fiber formed in accordance with the present invention may be useful in the production of tissue products having improved bulk and softness. More importantly, the modified fiber is adaptable to current tissue making processes and may be incorporated into a tissue product to improve bulk and softness without an unsatisfactory reduction in tensile. The cellulosic fiber formed in accordance with the invention is modified cellulosic fiber that has been reacted with a cyanuric halide selected from either a cyanuric halide or a vinyl sulfone. A decreased ability to hydrogen bond is imparted to the cellulosic fiber through reaction of the cellulosic fiber hydroxyl functional groups with the cyanuric halide, which impedes the hydroxyl functional groups from participating in hydrogen bonding with one another. Preferably the number of hydroxyl groups reacted on each cellulosic fiber are sufficient to impede hydrogen bonding to a degree sufficient to enhance bulk and softness, but not so significant so as to negatively affect tensile strength. For example, preferably the modified cellulosic fiber increases sheet bulk by at least about 25 percent, such as from about 25 to about 100 percent, while only decreasing the tissue product's tensile index by less than about 25 percent, and more preferably by less than about 20 percent.

Wood pulp fibers are a preferred starting material for preparing the modified cellulosic fibers of the invention. Wood pulp fibers may be formed by a variety of pulping processes, such as kraft pulp, sulfite pulp, thermomechanical pulp, and the like. Further, the wood fibers may be any high-average fiber length wood pulp, low-average fiber length wood pulp, or mixtures of the same. One example of suitable high-average length wood pulp fibers include softwood fibers such as, but not limited to, northern softwood, southern softwood, redwood, red cedar, hemlock, pine (e.g., southern pines), spruce (e.g., black spruce), combinations thereof, and the like. One example of suitable low-average length wood pulp fibers include hardwood fibers, such as, but not limited to, eucalyptus, maple, birch, aspen, and the like. In certain instances, eucalyptus fibers may be particularly desired to increase the softness of the web. Eucalyptus fibers can also enhance the brightness, increase the opacity, and change the pore structure of the tissue product to increase its wicking ability. Moreover, if desired, secondary fibers obtained from recycled materials may be used, such as fiber pulp from sources such as, for example, newsprint, reclaimed paperboard, and office waste.

In a particularly preferred embodiment hardwood pulp fibers modified with a cyanuric halide selected from either a cyanuric halide or a vinyl sulfone are utilized in the formation of tissue products to enhance their bulk and softness. In one particular embodiment, cyanuric halide modified hardwood pulp fibers, and more particularly modified eucalyptus kraft pulp fibers, are incorporated into a multi-layered web having a first layer comprising a blend of modified and unmodified hardwood kraft fibers and a second layer comprising softwood fiber. In such embodiments the modified fiber may be added to the first layer, such that the first layer comprises greater than about 2 percent, by weight of the layer, modified fiber, such as from about 2 to about 40 percent and more preferably from about 5 to about 30 percent.

The chemical composition of the modified fiber of the invention depends, in part, on the extent of processing of the cellulosic fiber from which the modified fiber is derived. In general, the modified fiber of the invention is derived from a fiber that has been subjected to a pulping process (i.e., a pulp fiber). Pulp fibers are produced by pulping processes that seek to separate cellulose from lignin and hemicellulose leaving the cellulose in fiber form. The amount of lignin and hemicellulose remaining in a pulp fiber after pulping will depend on the nature and extent of the pulping process. Thus, in certain embodiments the invention provides a modified fiber comprising lignin, cellulose, hemicellulose and a covalently bonded cyanuric halide.

Generally after reaction of the cyanuric halide and the pulp hydroxyl functional groups unreacted cyanuric halide is removed by washing. After washing, the extent of reaction between the pulp hydroxyl function groups and the cyanuric halide may be assessed by nitrogen elemental analysis in the case of a cyanuric halide reagent or sulfur elemental analysis in the case of a vinyl sulfone reagent of the modified pulp, with higher amounts of nitrogen indicating a greater extent of reaction. Accordingly, in one embodiment the modified fiber has a nitrogen content from about 0.05 to about 5 weight percent and more preferably from about 0.1 to about 3 weight percent.

As used herein, "modified fiber" refers to a cellulosic fiber that has been reacted with halogen atoms attached to a polyazine ring, for example fluorine, chlorine or bromine atoms attached to a pyridazine, pyrimidine or symtriazine ring. One preferred type of reagent contains one ring having three functional groups attached thereto. Other types of reagent, which may also be preferred, contain two reactive functional groups attached to each ring. Particularly preferred reagents are cyanuric halides having the general formula (I):

(I)

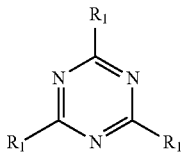

where $R_1$=chlorine, bromine, fluorine or iodine. In a particularly preferred embodiment the cyanuric halide is 2,4,6-trichlorotriazine, also referred to herein as cyanuric chloride.

In other embodiments the cyanuric halide may have the general Formula (II):

(II)

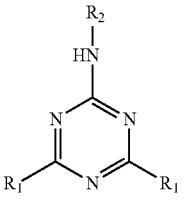

where $R_1$ equals F, Cl, Br, or I and $R_2$ equals $(CH_2)_n$—OH (n=1-3), $(CH_2)_n$—COOH (n=1-3), $C_6H_5$—COOH, or $HSO_3X$ where X equals $(CH_2)_n$ (n=1-3) or $C_6H_4$.

Any suitable process may be used to generate or place the cyanuric halides on the cellulosic fibers, which is generally referred to herein as "modification." Possible modification processes include any synthetic method(s) which may be used to associate the cyanuric halide with the cellulosic fibers. More generally, the modification step may use any process or combination of processes which promote or cause the generation of a modified cellulosic fiber. For example, in certain embodiments the cellulosic fiber is first reacted with alkaline agent followed by reaction with a cyanuric halide and then washed to remove excess alkali and unreacted reagent. In addition to alkali treatment, the cellulosic fiber may also be subjected to swelling. Alkali treatment and swelling may be provided by separate agents, or the same agent.

In a particularly preferred embodiment modification is carried out by alkali treatment to generate anionic groups, such as carboxyl, sulfate, sulfonate, phosphonate, and/or phosphate on the cellulosic fiber. Alkali treatment may be carried out before, after or coincidental to reaction with the cyanuric halide. Anionic groups are preferably generated under alkaline conditions, which in a preferred embodiment is obtained by using sodium hydroxide. In other embodiments the alkaline agent is selected from hydroxide salts, carbonate salts and alkaline phosphate salts. In still other embodiments the alkaline agent may be selected from alkali metal or alkaline earth metal oxides or hydroxides; alkali silicates; alkali aluminates; alkali carbonates; amines, including aliphatic hydrocarbon amines, especially tertiary amines; ammonium hydroxide; tetramethyl ammonium hydroxide; lithium chloride; N-methyl morpholine N-oxide; and the like.

In addition to the generation of anionic groups by the addition of an alkaline agent, swelling agents may be added to increase access for modification. Interfibrillar and intercrystalline swelling agents are preferred, particularly swelling agents used at levels which give interfibrillar swelling, such as sodium hydroxide at an appropriately low concentration to avoid negatively affecting the rheological performance of the fiber.

Either prior to or after alkali treatment, the cellulosic fiber is reacted with a cyanuric halide to form a modified fiber. The amount of reagent will vary depending on the type of cellulosic fiber, the desired degree of modification and the desired physical properties of the tissue web formed with modified fibers. In certain embodiments the mass ratio of cellulosic fiber to reagent is from about 5:0.05 to about 4:1, more preferably from about 5:0.1 to about 5:1, such that the weight percentage of reagent, based upon the cellulosic fiber is from about 1 to about 25 percent and more preferably from about 2 to about 20 percent.

Preferably the reaction of cyanuric halide and cellulosic fibers is carried out in an aqueous-alkaline solvent such as an aqueous medium containing at least one water-soluble organic solvent, the aqueous-alkaline solvent having a pH value greater than seven, more preferably greater than nine and more preferably greater than ten. More preferably the aqueous-alkaline solvent comprises an organic solvent selected from the group consisting of acetone, DMSO, DMF, acetonitrile, alcohols, polyalcohols, polyalcoholic ethers, pyridine, sulfolane, N-methyl pyrrolidinone and dioxane. In a particularly preferred embodiment the cyanuric halide is first dissolved in an organic solvent selected from the group consisting of acetone or isopropanol, resulting in a solution having a cyanuric halide concentration from about 0.1 to about 20 weight percent, more preferably from about 0.5 to about 10 weight percent.

Further, modification may be carried out at a variety of fiber consistencies. For example, in one embodiment modification is carried out at a fiber consistency greater than about 5 percent solids, more preferably greater than about 10 percent solids, such as from about 10 to about 50 percent solids. Preferably the reaction of reagent and cellulosic fibers is carried out in an aqueous-alkaline solvent solution such having a pH value greater than about seven, more preferably greater than nine and more preferably greater than about ten.

The reaction time and temperature should be sufficient the degree of modification, measured as the weight percent of nitrogen present in the fiber, where the reagent is a cyanuric chloride, is at least about 0.05 weight percent, such as from about 0.05 to about 5 weight percent, and more preferably from about 0.1 to about 3 weight percent. Accordingly, in certain embodiments, the treatment according to the invention can be carried at a temperature from about 0 about 40° C. The usual treatment times at room temperature (about 20° C.) are from 30 minutes to 24 hours, more preferably from about 30 minutes to 10 hours, and more preferably from about 40 minutes to 5 hours.

As noted previously, the degree of modification may be measured by elemental analysis of the reacted cellulosic fiber. For example, where the cyanuric halide is a cyanuric halide, the nitrogen content of fiber is increased upon modification. The increase in nitrogen results mainly from the heterocyclically bonded nitrogen of the modified triazine ring, because the nitrogen content for an unmodified cellulose fiber material is very low, generally less than about 0.01 percent. Upon reaction with a cyanuric halide as described herein, the nitrogen content may be increased to greater than about 0.05 weight percent, and more preferably greater than about 0.1 weight percent, such as from about 0.1 to about 5 weight percent and still more preferably from about 0.3 to about 1 weight percent.

Typically, tissue webs comprising modified fiber in an amount from about 1 to about 50 and more preferably from about 5 to about 20 weight percent, based upon the total weight of the web, are sufficient to improve the bulk and softness of a tissue product comprising modified fibers. For example, a tissue product produced without modified fiber and two tissue products comprising different amounts of modified fiber are compared below.

TABLE 1

| Wt % Modified Fiber | Sheet Bulk (cc/g) | TS7 Value | Delta Sheet Bulk | Delta TS7 Value |
|---|---|---|---|---|
| — | 5.2 | 9.38 | — | — |
| 23.1% | 6.8 | 7.85 | 31% | −16% |
| 52.5% | 8.1 | 5.28 | 56% | −44% |

Webs that include the modified fibers can be prepared in any one of a variety of methods known in the web-forming art. The methods include airlaid and wet forming methods. In a particularly preferred embodiment modified fibers are incorporated into tissue webs formed by through-air drying and can be either creped or uncreped. For example, a papermaking process of the present disclosure can utilize adhesive creping, wet creping, double creping, embossing, wet-pressing, air pressing, through-air drying, creped through-air drying, uncreped through-air drying, as well as other steps in forming the paper web. Some examples of such techniques are disclosed in U.S. Pat. Nos. 5,048,589, 5,399,412, 5,129,988 and 5,494,554 all of which are incorporated herein in a manner consistent with the present disclosure. When forming multi-ply tissue products, the separate plies can be made from the same process or from different processes as desired.

For example, in one embodiment, tissue webs may be creped through-air dried webs formed using processes known in the art. To form such webs, an endless traveling forming fabric, suitably supported and driven by rolls, receives the layered papermaking stock issuing from the headbox. A vacuum box is disposed beneath the forming fabric and is adapted to remove water from the fiber furnish to assist in forming a web. From the forming fabric, a formed web is transferred to a second fabric, which may be either a wire or a felt. The fabric is supported for movement around a continuous path by a plurality of guide rolls. A pick up roll designed to facilitate transfer of web from fabric to fabric may be included to transfer the web.

Preferably the formed web is dried by transfer to the surface of a rotatable heated dryer drum, such as a Yankee dryer. The web may be transferred to the Yankee directly from the throughdrying fabric or, preferably, transferred to an impression fabric which is then used to transfer the web to the Yankee dryer. In accordance with the present disclosure, the creping composition of the present disclosure may be applied topically to the tissue web while the web is traveling on the fabric or may be applied to the surface of the dryer drum for transfer onto one side of the tissue web. In this manner, the creping composition is used to adhere the tissue web to the dryer drum. In this embodiment, as the web is carried through a portion of the rotational path of the dryer surface, heat is imparted to the web causing most of the moisture contained within the web to be evaporated. The web is then removed from the dryer drum by a creping blade. The creping web as it is formed further reduces internal bonding within the web and increases softness. Applying the creping composition to the web during creping, on the other hand, may increase the strength of the web.

In another embodiment the formed web is transferred to the surface of the rotatable heated dryer drum, which may be a Yankee dryer. The press roll may, in one embodiment, comprise a suction pressure roll. In order to adhere the web to the surface of the dryer drum, a creping adhesive may be applied to the surface of the dryer drum by a spraying device. The spraying device may emit a creping composition made in accordance with the present disclosure or may emit a conventional creping adhesive. The web is adhered to the surface of the dryer drum and then creped from the drum using the creping blade. If desired, the dryer drum may be associated with a hood. The hood may be used to force air against or through the web.

In other embodiments, once creped from the dryer drum, the web may be adhered to a second dryer drum. The second dryer drum may comprise, for instance, a heated drum surrounded by a hood. The drum may be heated from about 25 to about 200° C., such as from about 100 to about 150° C.

In order to adhere the web to the second dryer drum, a second spray device may emit an adhesive onto the surface of the dryer drum. In accordance with the present disclosure, for instance, the second spray device may emit a creping composition as described above. The creping composition not only assists in adhering the tissue web to the dryer drum, but also is transferred to the surface of the web as the web is creped from the dryer drum by the creping blade.

Once creped from the second dryer drum, the web may, optionally, be fed around a cooling reel drum and cooled prior to being wound on a reel.

For example, once a fibrous web is formed and dried, in one aspect, the creping composition may be applied to at least one side of the web and the at least one side of the web may then be creped. In general, the creping composition may be applied to only one side of the web and only one side of the web may be creped, the creping composition may be applied to both sides of the web and only one side of the web is creped, or the creping composition may be applied to each side of the web and each side of the web may be creped.

Once creped the tissue web may be pulled through a drying station. The drying station can include any form of a heating unit, such as an oven energized by infra-red heat, microwave energy, hot air, or the like. A drying station may be necessary in some applications to dry the web and/or cure the creping composition. Depending upon the creping composition selected, however, in other applications a drying station may not be needed.

In other embodiments, the base web is formed by an uncreped through-air drying process such as those described, for example, in U.S. Pat. Nos. 5,656,132 and 6,017,417, both of which are hereby incorporated by reference herein in a manner consistent with the present disclosure. The uncreped through-air drying process may comprise a twin wire former having a papermaking headbox which injects or deposits a furnish of an aqueous suspension of wood fibers onto a plurality of forming fabrics, such as an outer forming fabric and an inner forming fabric, thereby forming a wet tissue web. The forming process may be any conventional forming process known in the papermaking industry. Such formation processes include, but are not limited to, Fourdriniers, roof formers such as suction breast roll formers, and gap formers such as twin wire formers and crescent formers.

The wet tissue web forms on the inner forming fabric as the inner forming fabric revolves about a forming roll. The inner forming fabric serves to support and carry the newly-formed wet tissue web downstream in the process as the wet tissue web is partially dewatered to a consistency of about 10 percent based on the dry weight of the fibers. Additional dewatering of the wet tissue web may be carried out by known paper making techniques, such as vacuum suction boxes, while the inner forming fabric supports the wet tissue web. The wet tissue web may be additionally dewatered to a consistency of at least about 20 percent, more specifically between about 20 to about 40 percent, and more specifically about 20 to about 30 percent.

The forming fabric can generally be made from any suitable porous material, such as metal wires or polymeric filaments. For instance, some suitable fabrics can include, but are not limited to, Albany 84M and 94M available from Albany International (Albany, N.Y.) Asten 856, 866, 867, 892, 934, 939, 959, or 937; Asten Synweve Design 274, all of which are available from Asten Forming Fabrics, Inc. (Appleton, Wis.); and Voith 2164 available from Voith Fabrics (Appleton, Wis.). The wet web is then transferred from the forming fabric to a transfer fabric while at a solids consistency of between about 10 to about 35 percent, and particularly, between about 20 to about 30 percent. As used herein, a "transfer fabric" is a fabric that is positioned between the forming section and the drying section of the web manufacturing process.

Transfer to the transfer fabric may be carried out with the assistance of positive and/or negative pressure. For example, in one embodiment, a vacuum shoe can apply negative pressure such that the forming fabric and the transfer fabric simultaneously converge and diverge at the leading edge of the vacuum slot. Typically, the vacuum shoe supplies pressure at levels between about 10 to about 25 inches of mercury. As stated above, the vacuum transfer shoe (negative pressure) can be supplemented or replaced by the use of positive pressure from the opposite side of the web to blow the web onto the next fabric. In some embodiments, other vacuum shoes can also be used to assist in drawing the fibrous web onto the surface of the transfer fabric.

Typically, the transfer fabric travels at a slower speed than the forming fabric to enhance the MD and CD stretch of the web, which generally refers to the stretch of a web in its cross (CD) or machine direction (MD) (expressed as percent elongation at sample failure). For example, the relative speed difference between the two fabrics can be from about 1 to about 30 percent, in some embodiments from about 5 to about 20 percent, and in some embodiments, from about 10 to about 15 percent. This is commonly referred to as "rush transfer." During "rush transfer," many of the bonds of the web are believed to be broken, thereby forcing the sheet to bend and fold into the depressions on the surface of the transfer fabric 8. Such molding to the contours of the surface of the transfer fabric 8 may increase the MD and CD stretch of the web. Rush transfer from one fabric to another can follow the principles taught in any one of the following patents, U.S. Pat. Nos. 5,667,636, 5,830,321, 4,440,597, 4,551,199, 4,849,054, all of which are hereby incorporated by reference herein in a manner consistent with the present disclosure. The wet tissue web is then transferred from the transfer fabric to a throughdrying fabric.

While supported by the throughdrying fabric, the wet tissue web is dried to a final consistency of about 94 percent or greater by a throughdryer. The drying process can be any noncompressive drying method which tends to preserve the bulk or thickness of the wet web including, without limitation, throughdrying, infra-red radiation, microwave drying, etc. Because of its commercial availability and practicality, throughdrying is well known and is one commonly used means for noncompressively drying the web for purposes of this invention. Suitable throughdrying fabrics include, without limitation, fabrics with substantially continuous machine direction ridges whereby the ridges are made up of multiple warp strands grouped together, such as those disclosed in U.S. Pat. Nos. 6,998,024 and 7,611,607, both of which are incorporated herein in a manner consistent with the present disclosure, particularly the fabrics denoted as Fred (t1207-77), Jetson (t1207-6) and Jack (t1207-12). The web is preferably dried to final dryness on the throughdrying fabric, without being pressed against the surface of a Yankee dryer, and without subsequent creping.

Additionally, webs prepared according to the present disclosure may be subjected to any suitable post processing including, but not limited to, printing, embossing, calendering, slitting, folding, combining with other fibrous structures, and the like.

The basis weight of tissue webs made in accordance with the present disclosure can vary depending upon the final product. For example, the process may be used to produce bath tissues, facial tissues, paper towels, and the like. In general, the basis weight of such fibrous products may vary from about 5 to about 110 gsm, such as from about 10 to about 90 gsm. For bath tissue and facial tissues products, for instance, the basis weight of the product may range from about 10 to about 40 gsm.

Likewise, tissue web basis weight may also vary, such as from about 5 to about 50 gsm, more preferably from about 10 to about 30 gsm and still more preferably from about 14 to about 20 gsm.

In multiple-ply products, the basis weight of each web present in the product can also vary. In general, the total basis weight of a multiple ply product will generally be from about 10 to about 100 gsm. Thus, the basis weight of each ply can be from about 10 to about 60 gsm, such as from about 20 to about 40 gsm.

Tissue webs and products produced according to the present disclosure also have good bulk characteristics, regardless of the method of manufacture. For instance, conventional wet pressed tissue prepared using modified fibers may have a sheet bulk greater than about 5 $cm^3/g$, such as from about 5 to about 15 $cm^3/g$ and more preferably from about 8 to about 10 $cm^3/g$. In other embodiments through-air dried tissue and more preferably uncreped through-air dried tissue comprising modified fibers have a sheet bulk greater than about 10 $cm^3/g$, such as from about 10 to about 20 $cm^3/g$ and more preferably from about 12 to about 15 $cm^3/g$.

In still other embodiments tissue webs comprising modified fibers have improved absorbent capacity compared to fibers prepared with unmodified fibers. For example, in certain embodiments, tissue webs comprising modified fibers have an absorbent capacity greater than about 8 g/g, such as from about 8 to about 12 g/g. In particularly preferred embodiments, the present invention provides a tissue web having a basis weight of at least about 15 gsm comprising from about 10 to about 50 percent by weight modified fibers and having an absorbent capacity greater than about 8 g/g, such as from about 8 to about 12 g/g.

In addition to having good bulk, tissue webs and products prepared according to the present disclosure have improved softness and surface smoothness. For example, tissue webs prepared according to the present disclosure have TS7 values less than about 8.0, such as from about 5.0 to about 7.0 and in certain embodiments a TS750 value less than about 7.0, such as from about 4.0 to about 6.0. In a particularly preferred embodiment the present disclosure provides a multi-ply creped tissue product comprising from about 20 to about 80 weight percent modified fiber based upon the total weight of the product, a GMT of at least about 300 g/3" and a TS7 value from about 5.0 to about 8.0.

Moreover, the low TS7 and/or TS750 values are achieved at relatively modest geometric mean tensile strengths. For example, tissue products prepared according to the present disclosure have geometric mean tensile strengths of less than about 1000 g/3", and more preferably less than about 900 g/3", such as from about 300 to about 600 g/3".

In addition to varying the amount of modified fiber within the web, as well as the amount in any given layer, the physical properties of the web may be varied by specifically selecting particular layer(s) for incorporation of the modified fibers. For example, it has now been discovered that the greatest increase in bulk and softness, without significant decreases in tensile strength, may be achieved by forming a two layered tissue web where the modified fibers are selectively incorporated into the first layer and the second layer consists essentially of softwood kraft fibers.

In a particularly preferred embodiment, the present disclosure provides a tissue web having enhanced bulk and softness without a significant decrease in tensile, where the web comprises a first and a second fibrous layer, wherein the first fibrous layer comprises hardwood kraft fibers and modified fibers and the second fibrous layer comprises softwood kraft fibers, wherein the amount of modified fibers is from about 2 to about 80 percent and more preferably from about 5 to about 20 percent by weight of the web. Preferably multi-layered webs having modified fibers selectively incorporated into the first fibrous layer have basis weights of at least about 15 gsm and geometric mean tensile strengths greater than about 300 g/3", such as from about 300 to about 1500 g/3".

In a particularly preferred embodiment the present invention provides a tissue web comprising modified fibers, wherein the amount of modified fibers is from about 5 to about 20 weight percent of the total weight of the web, the tissue web having a bulk greater than about 5 cc/g, such as from about 8 to about 15 cc/g. Further, the tissue web preferably has low TS7 values, such as less than about 7.5, more preferably from about 5 to about 7 and still more preferably from about 5.5 to about 6.5.

While the web properties, such as tensile, bulk and softness may be varied by selectively incorporating modified fibers into a particular layer of a multi-layered web, the benefits of using modified fibers may also be achieved by blending modified fibers and wood fibers to form a blended tissue web. In particular, modified fibers may be blended with wood fibers to increase bulk and softness, compared to webs made from wood fibers alone. Such blended tissue webs comprise at least about 5 percent by weight of the web modified fiber, and more preferably at least 10 percent, such as from about 10 to about 50 percent, and have a geometric mean tensile strength greater than about 300 g/3" and more preferably greater than about 500 g/3", such as from about 500 to about 700 g/3".

In other embodiments the present disclosure provides a two-ply tissue product comprising an upper multi-layered tissue web and a lower multi-layered tissue web that are plied together using well-known techniques. The multi-layered webs comprise at least a first and a second layer, wherein modified fibers are selectively incorporated in only one of the layers, such that when the webs are plied together the layers containing the modified fibers are brought into contact with the user's skin in-use. For example, the two-ply tissue product may comprise a first and second tissue web, wherein the tissue webs each comprise a first and second layer. The first layer of each tissue web comprises wood fibers and modified fibers and, while the second layer of each tissue web is substantially free of modified fibers. When the tissue webs are plied together to form the tissue product the second layers of each web are arranged in a facing relationship such that the modified fibers are brought into contact with the user's skin in-use.

Test Methods

Sheet Bulk

Sheet Bulk is calculated as the quotient of the dry sheet caliper expressed in microns, divided by the dry basis weight, expressed in grams per square meter (gsm). The resulting Sheet Bulk is expressed in cubic centimeters per gram. More specifically, the Sheet Bulk is the representative caliper of a single tissue sheet measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board." The micrometer used for carrying out T411 om-89 is an Emveco 200-A Tissue Caliper Tester (Emveco, Inc., Newberg, Oreg.). The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second.

Tensile

Tensile testing was done in accordance with TAPPI test method T-576 "Tensile properties of towel and tissue products (using constant rate of elongation)" wherein the testing is conducted on a tensile testing machine maintaining a constant rate of elongation and the width of each specimen tested is 3 inches. More specifically, samples for dry tensile strength testing were prepared by cutting a 3±0.05 inch (76.2±1.3 mm) wide strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333) or equivalent. The instrument used for measuring tensile strengths was an MTS Systems Sintech 11S, Serial No. 6233. The data acquisition software was an MTS TestWorks® for Windows Ver. 3.10 (MTS Systems Corp., Research Triangle Park, N.C.). The load cell was selected from either a 50 Newton or 100 Newton maximum, depending on the strength of the sample being tested, such that the majority of peak load values fall between 10 to 90 percent of the load cell's full scale value. The gauge length between jaws was 4±0.04 inches (101.6±1 mm) for facial tissue and towels and 2±0.02 inches (50.8±0.5 mm) for bath tissue. The crosshead speed was 10±0.4 inches/min (254±1 mm/min), and the break sensitivity was set at 65 percent. The sample was placed in the jaws of the instrument, centered both vertically and horizontally. The test was then started and ended when the specimen broke. The peak load was recorded as either the "MD tensile strength" or the "CD tensile strength" of the specimen depending on direction of the sample being tested. Ten representative specimens were tested for each product or sheet and the arithmetic average of all individual specimen tests was recorded as the appropriate MD or CD tensile strength the product or sheet in units of grams of force per 3 inches of sample. The geometric mean tensile (GMT) strength was calculated and is expressed as grams-force per 3 inches of sample width. Tensile energy absorbed (TEA) and slope are also calculated by the tensile tester. TEA is reported in units of $gm*cm/cm^2$. Slope is recorded in units of kg. Both TEA and Slope are directional dependent and thus MD and CD directions are measured independently. Geometric mean TEA and geometric mean slope are defined as the square root of the product of the representative MD and CD values for the given property.

TS7 and TS750 Values

TS7 and TS750 values were measured using an EMTEC Tissue Softness Analyzer ("TSA") (Emtec Electronic GmbH, Leipzig, Germany). The TSA comprises a rotor with vertical blades which rotate on the test piece applying a defined contact pressure. Contact between the vertical blades and the test piece creates vibrations, which are sensed by a vibration sensor. The sensor then transmits a signal to a PC for processing and display. The signal is displayed as a frequency spectrum. For measurement of TS7 and TS750 values the blades are pressed against sample with a load of 100 mN and the rotational speed of the blades is 2 revolutions per second.

To measure TS7 and TS750 values two different frequency analyses are performed. The first frequency analysis is performed in the range of approximately 200 to 1000 Hz, with the amplitude of the peak occurring at 750 Hz being recorded as the TS750 value. The TS750 value represents the surface smoothness of the sample. A high amplitude peak correlates to a rougher surface. A second frequency analysis is performed in the range from 1 to 10 kHZ, with the amplitude of the peak occurring at 7 kHz being recorded as the TS7 value. The TS7 value represents the softness of sample. A lower amplitude correlates to a softer sample. Both TS750 and TS7 values have the units $dB\ V^2$ rms.

To measure the stiffness properties of the test sample, the rotor is initially loaded against the sample to a load of 100 mN. Then, the rotor is gradually loaded further until the load reaches 600 mN. As the sample is loaded the instrument records sample displacement (μm) versus load (mN) and outputs a curve over the range of 100 to 600 mN. The modulus value "E" is reported as the slope of the displacement versus loading curve for this first loading cycle, with units of mm displacement/N of loading force. After the first loading cycle from 100 to 600 mN is completed, the instrument reduces the load back to 100 mN and then increases the load again to 600 mN for a second loading cycle. The slope of the displacement versus loading curve from the second loading cycle is called the "D" modulus value.

Test samples were prepared by cutting a circular sample having a diameter of 112.8 mm. All samples were allowed to equilibrate at TAPPI standard temperature and humidity conditions for at least 24 hours prior to completing the TSA testing. Only one ply of tissue is tested. Multi-ply samples are separated into individual plies for testing. The sample is placed in the TSA with the softer (dryer or Yankee) side of the sample facing upward. The sample is secured and the measurements are started via the PC. The PC records, processes and stores all of the data according to standard TSA protocol. The reported values are the average of five replicates, each one with a new sample.

Absorbent Capacity

Absorbent capacity is a measure of the amount of liquid that an initially 4-inch by 4-inch (102 mm×102 mm) sample of material can absorb while in contact with a pool 2 inches (51 mm) deep of room-temperature (23±2° C.) water for 3 minutes±5 seconds in a standard laboratory atmosphere of 23±1° C. and 50±2% RH and still retain after being removed from contact with water and being clamped by a one-point clamp to drain for 3 minutes±5 seconds. Absorbent capacity is expressed as both an absolute capacity in grams of liquid and as a specific capacity of grams of liquid held per gram of bone dry fiber, as measured to the nearest 0.01 gram. At least three specimens are tested for each sample.

EXAMPLES

Preparation of Modified Wood Pulp Fibers

Modified wood pulps were prepared by mixing about 10 g of eucalyptus kraft pulp and 800 g of 3% NaOH for about 5 minutes to swell the pulp fibers. After mixing, the NaOH solution was removed by centrifugal filtration and/or mechanical pressing until the swelled pulp weight reached 30 g. A pre-determined amount of cyanuric chloride was measured separately and dissolved in 50 ml acetone (see Table 2, below) and added to the pulp at various addition amounts based upon the mass of the pulp (see Table 2, below). The pulp/cyanuric chloride mixture was stirred at 200 rpm at 30° C. for 2 hours. After the reaction was completed, the pulp was washed with 50 ml acetone to remove unreacted cyanuric chloride. The pulp was then washed with 50 ml water and subjected to vacuum filtration. The washed pulp was dried at 70° C. in a convection oven for 24 hours.

Elemental analysis was done to confirm the reaction of cyanuric chloride with pulp cellulose. The amounts of nitrogen increased proportional to the addition amount of cyanuric chloride. No nitrogen was detected in non-treated pulp. The results of the elemental analysis are summarized in Table 2, below.

TABLE 2

| Pulp (g) | Cyanuric Chloride (g) | Cyanuric Chloride (wt %) | Nitrogen (%) |
|---|---|---|---|
| 10 | 1.0 | 10% | 1.59 |
| 10 | 0.5 | 5% | 0.70 |
| 10 | 0.3 | 3% | 0.32 |
| 10 | 0.1 | 1% | 0.05 |
| 10 | 0.0 | 0% | 0.00 |
| Control Pulp fiber | | NA | 0.00 |

Figure 2:
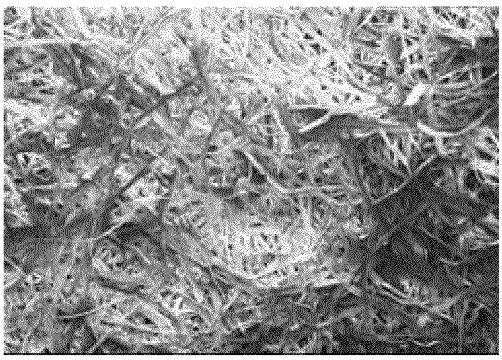
FIG. 2 is an SEM image comparing handsheets prepared from modified and unmodified fiber.
Figure 2:
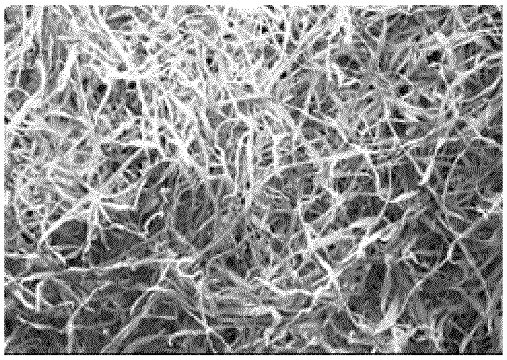
Figure 3:
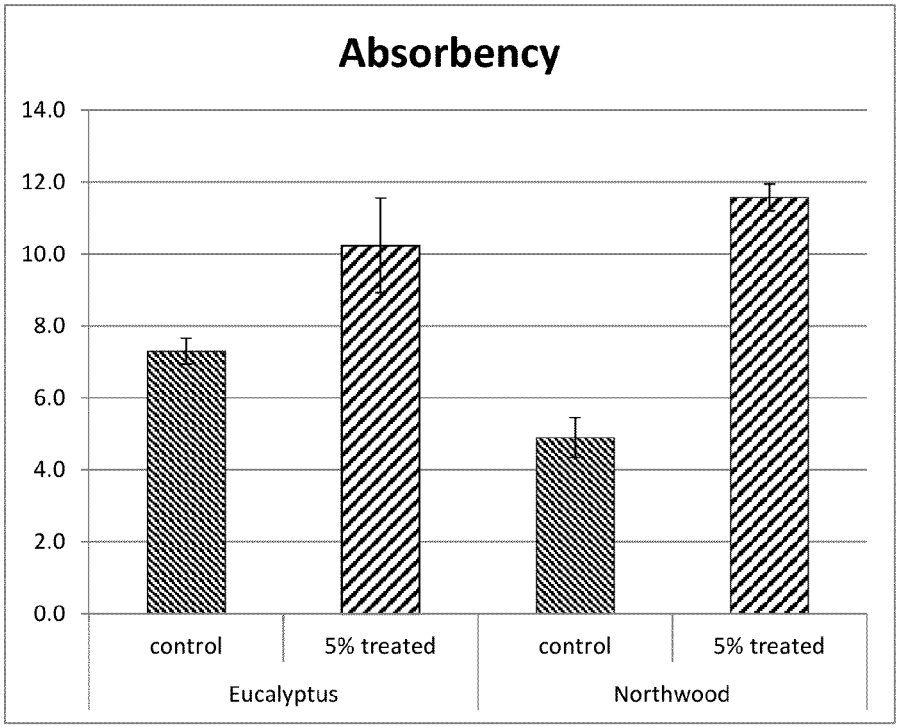
FIG. 3 is a graph of absorbency (y-axis) versus treated and untreated fiber (x-axis) and illustrates the effect of modified fibers on absorbency.
Figure 4:
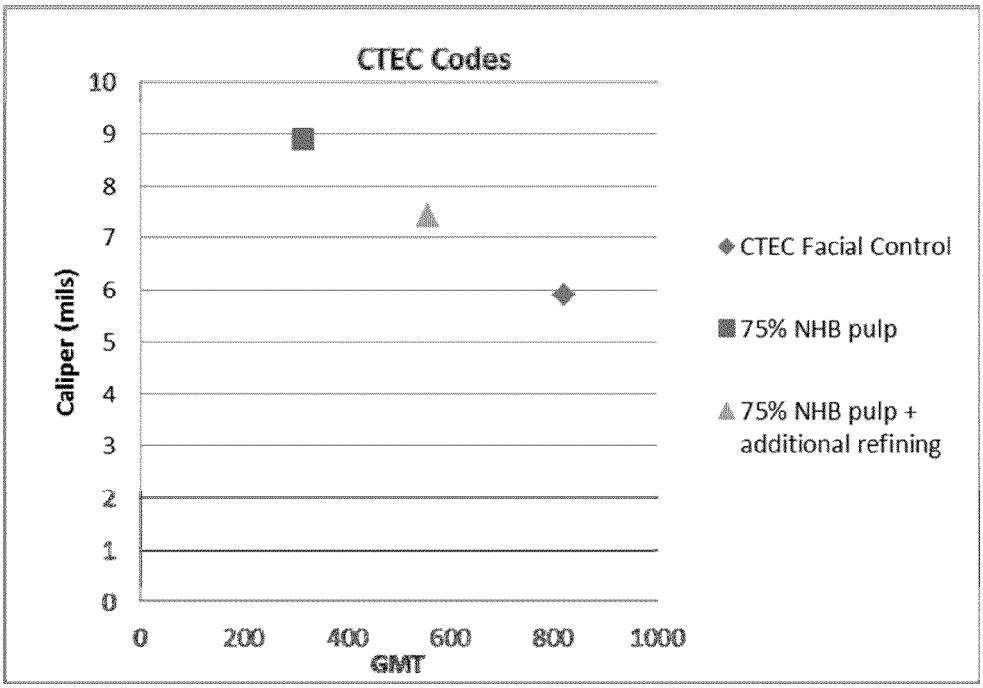
FIG. 4 is a graph of sheet caliper (y-axis) versus GMT (x-axis) and illustrates the effect of modified fiber on sheet properties.
Figure 5:
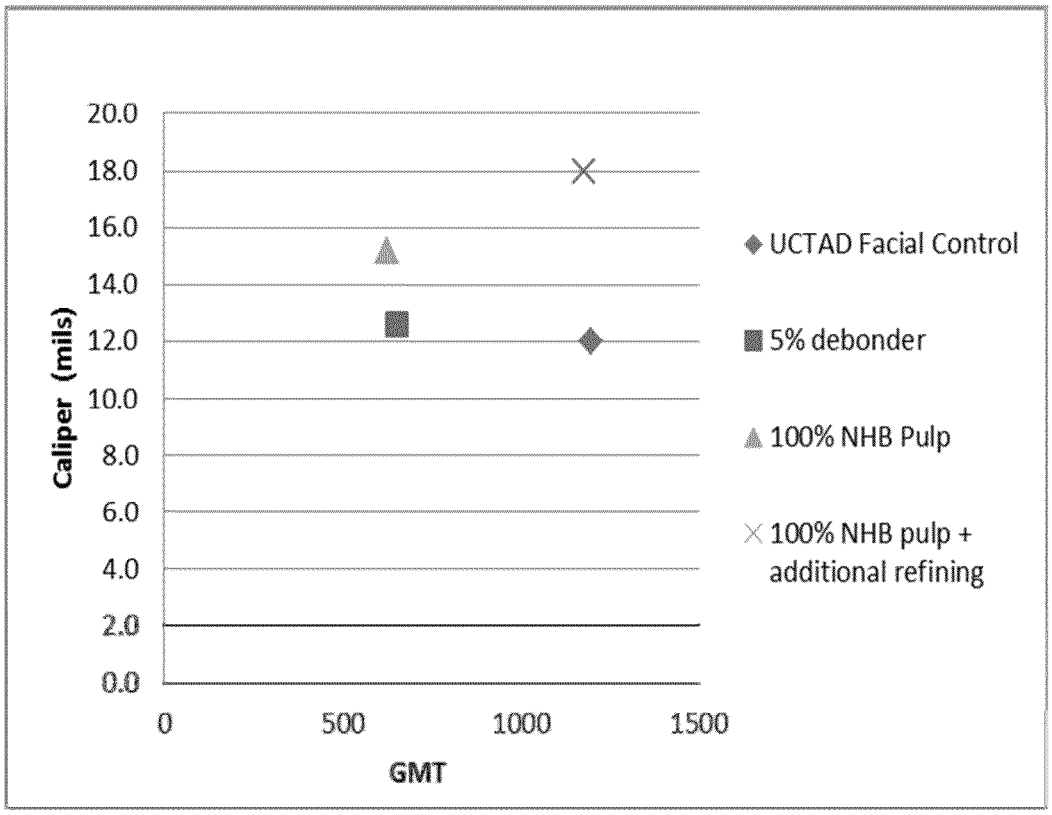
FIG. 5 is a graph of sheet caliper (y-axis) versus GMT (x-axis) and illustrates the effect of modified fiber on sheet properties.

Scanning electron microscopy (SEM) images of select handsheets (prepared as described below) were obtained using the JSM-6490LV scanning electron microscope under the following operating conditions: accelerating voltage is 10 kilovolts; spot size is 40, working distance 20 millimeters, and magnification 300× to 500×. Handsheet cross-sections were prepared by cleaving the sheet with a fresh, razor blade at liquid nitrogen temperatures. The handsheet samples were mounted with double-stick tape and metallized with gold using a vacuum sputter for proper imaging in the SEM. A side-by-side comparison of a handsheet comprising modified pulp and a handsheet comprising unmodified pulp is shown in FIG. 2.

Handsheets Comprising Modified Wood Pulp Fibers

Handsheets were prepared using a lab handsheet former (Retention & Drainage Analyzer, GE-RDA-T6, commercially available from GIST Co., Ltd., Daejeon, Korea). The pulp (either treated or control) was mixed with distilled water to form slurries at a ratio of 25 g pulp (on dry basis) to 2 L of water. The pulp/water mixture was subjected to disintegration using an L&W disintegrator Type 965583 for 5 minutes at a speed of 2975±25 RPM. After disintegration the mixture was further diluted by adding 4 L of water. Handsheets having a basis weight of 70.5 g/m$^2$ (gsm) were formed using the wet laying handsheet former. Wet handsheets were pressed using a Carver AutoFour/15H-12 press at a pressure of 8000 KGS for 1 minute without the addition of heat. The pressed handsheet was then dried at 250° F. for 2 minutes. Handsheet caliper and tensile were measured and are reported in Table 3, below.

TABLE 3

| Sample | Alkali Treatment | Cyanuric Chloride (wt %) | Caliper (mm) | Tensile (g/3") |
|---|---|---|---|---|
| Control 1 | No | 0 | 0.190 | 3252 |
| Control 2 | Yes | 0 | 0.190 | 2222 |
| 1 | Yes | 1 | 0.304 | 686 |
| 3 | Yes | 3 | 0.391 | 309 |
| 4 | Yes | 5 | 0.467 | 204 |
| 5 | Yes | 10 | 0.501 | 173 |

Two commercial debonders were tested to compare the debonding capability. Debonder was added to the pulp fiber slurry immediately prior to forming handsheets. The effect of cyanuric chloride and commercial debonders on tensile strength and caliper is reported in Table 4, below.

TABLE 4

| Sample | Cyanuric Chloride (wt %) | Debonder (wt %) | Tensile (g/3") | Delta Tensile (%) | Caliper (mm) | Delta Caliper (%) |
|---|---|---|---|---|---|---|
| Control | — | — | 3252 | | 0.190 | — |
| 1 | 1 | — | 686 | −79% | 0.304 | 60% |
| 4 | 5 | — | 204 | −94% | 0.467 | 146% |
| 6 | — | Prosoft TQ 1003 (1%) | 1663 | −49% | 0.181 | −4.7% |
| 7 | — | Prosoft TQ 1003 (5%) | 710 | −78% | 0.198 | 4.2% |
| 8 | — | Unicole AT VP-20 (1%) | 768 | −76% | 0.193 | 1.6% |
| 9 | — | Unicole AT VP-20 (5%) | 357 | −89% | 0.214 | 12.6% |

Absorbency capacity was also measured, as described in the Test Methods section, and the results are shown in Table 5, below. The handsheets prepared from modified pulp fibers had high absorbency compared to handsheets prepared from unmodified fiber.

TABLE 5

| Sample | Wood Pulp | Cyanuric Chloride (wt %) | Absorbency (g/g) | Delta Absorbency (%) |
|---|---|---|---|---|
| Control | EHWK | — | 7.3 | — |
| Modified | MEHWK | 5 | 10.2 | 2.9 |
| Control | NSWK | — | 4.9 | — |
| Modified | MNSWK | 5 | 11.6 | 6.7 |

To determine whether the tensile strength of handsheets comprising modified pulp could be increased without negatively effecting caliper, handsheets were prepared with various additional levels of Kymene™ 6500 (available from Ashland, Covington, Ky.). The handsheet composition and resulting physical properties are summarized in Table 6, below.

TABLE 6

| Sample | Cyanuric Chloride (wt %) | Kymene ™ 6500 (wt %) | Tensile (g/3") | Delta Tensile (%) | Caliper (mm) | Delta Caliper (%) |
|---|---|---|---|---|---|---|
| Control | 5 | — | 125 | — | 0.523 | — |
| 1 | 5 | 0.8 | 197 | 58 | 0.534 | 2 |
| 2 | 5 | 1.6 | 243 | 94 | 0.539 | 3 |

Tissue Comprising Modified Pulp Fibers

Two different tissue products were manufactured using modified pulp fibers, a 2-ply modified wet pressed (referred to herein as "CTEC") facial tissue and a 1-ply uncreped through-air dried (referred to herein as "UCTAD") bath tissue. Commodity pulps were obtained as follows—Eucalyptus kraft pulp ("EHWK") was obtained from Fibria (San Paulo, Brazil) and North softwood kraft pulp ("NSWK") was obtained from Northern Pulp Nova Scotia Corporation (Abercrombie, NS).

Modified fiber was prepared by mixing 40 kg of EHWK and 1000 kg of 3 wt % NaOH solution for 10 minutes. Excess NaOH solution was removed by centrifugal dehydrator until 145 kg of alkali treated pulp was obtained. A cyanuric chloride solution was prepared by dissolving 2 kg of cyanuric chloride in 1200 L acetone. The alkali treated pulp (145 kg) was then mixed with the cyanuric chloride solution. The mixture was agitated at 30° C. for 2 hours. After reaction was completed, excess acetone was removed by a centrifugal dehydrator, followed by washing with 1000 kg of water and removal of excess water by a centrifugal dehydrator. The process of washing with 500 kg of water and centrifugation was repeated three times to yield 88 kg of modified pulp (MEHWK).

CTEC tissue webs were made using a wet pressed process utilizing a Crescent Former according to the following process. Initially NSWK was dispersed in a pulper for 30 minutes at 3 percent consistency at about 100° F. The NSWK was then transferred to a dump chest and subsequently diluted to approximately 0.75 percent consistency. EHWK was dispersed in a pulper for 30 minutes at about 3 percent consistency at about 100° F. The EHWK was then transferred to a dump chest and subsequently diluted to about 0.75 percent consistency. Modified eucalyptus hardwood kraft, prepared as described above, was dispersed in a pulper for 30 minutes at about 3 percent consistency at about 100° F. and then transferred to a dump chest and subsequently diluted to about 0.75 percent consistency.

The pulp slurries were subsequently pumped to separate machine chests and further diluted to a consistency of about 0.1 percent. Pulp fibers from each machine chest were sent through separate manifolds in the headbox to create a 3-layered tissue structure. The flow rates of the stock pulp fiber slurries into the flow spreader were adjusted to give a target web basis. In those instances where a layer structure was produced, flow of stock pulp fiber slurries was controlled to provide a layer split of about 30 to about 35 percent by total weight of the tissue web EHWK and/or MEHWK on both outer layers and 30 to about 40 percent NSWK in the center layer. The fibers were deposited onto a felt using a Crescent Former.

The wet sheet, about 10 to 20 percent consistency, was adhered to a Yankee dryer, traveling at about 80 to 120 fpm through a nip via a pressure roll. The consistency of the wet sheet after the pressure roll nip (post-pressure roll consistency or PPRC) was approximately 40 percent. A spray boom situated underneath the Yankee dryer sprayed a creping composition at a pressure of 60 psi at a rate of approximately 0.25 g solids/$m^2$ of product. The creping composition comprised 0.16 percent by weight of polyvinyl alcohol (PVOH), (Celvol™ 523 available from Celanese Chemicals, Calvert City, Ky.), 0.013 percent by weight PAE resin (Kymene™ 6500 available from Ashland, Covington, Ky.) and 0.0013 percent by weight of Resozol™ 2008 (Ashland, Covington, Ky.).

The sheet was dried to about 98 to 99 percent consistency as it traveled on the Yankee dryer and to the creping blade. The creping blade subsequently scraped the tissue sheet and a portion of the creping composition off the Yankee dryer. The creped tissue basesheet was then wound onto a core traveling at about 50 to about 100 fpm into soft rolls for converting. Samples produced according to the present example are summarized in Tables 7 and 8 below.

In addition to two-ply facial tissue, a single ply through-air dried tissue web was made generally in accordance with U.S. Pat. No. 5,607,551, which is herein incorporated by reference in a manner consistent with the present disclosure. Initially NSWK was dispersed in a pulper for 30 minutes at 3 percent consistency at about 100° F. The NSWK was then transferred to a dump chest and subsequently diluted to approximately 0.75 percent consistency. EHWK was dispersed in a pulper for 30 minutes at about 3 percent consistency at about 100° F. The EHWK was then transferred to a dump chest and subsequently diluted to about 0.75 percent consistency. MEHWK prepared as described above, was dispersed in a pulper for 30 minutes at about 3 percent consistency at about 100° F. and then transferred to a dump chest and subsequently diluted to about 0.75 percent consistency.

The pulp slurries were subsequently pumped to separate machine chests and further diluted to a consistency of about 0.1 percent. Pulp fibers from each machine chest were sent through separate manifolds in the headbox to create a 3-layered tissue structure. The flow rates of the stock pulp fiber slurries into the flow spreader were adjusted to give a target web basis. The fiber compositions of the layered sheets are described in Table 7, below. The formed web was non-compressively dewatered and rush transferred to a transfer fabric traveling at a speed about 25 percent slower than the forming fabric. The web was then transferred to a throughdrying fabric and dried.

TABLE 7

| Sample | Manufacturing Method | Layer Structure (wt %) | Outer Layer Furnish | Middle Layer Furnish | Additives | Middle Layer Fiber Refining Time (min) |
|---|---|---|---|---|---|---|
| 601 | CTEC | 35/30/35 | 100% EHWK | 100% NSWK | 0 | 6 |
| 602 | CTEC | 35/30/35 | 33% MEHWK 67% EHWK | 100% NSWK | 0 | 6 |
| 603 | CTEC | 35/30/35 | 50% MEHWK 50% EHWK | 100% NSWK | 0 | 6 |
| 604 | CTEC | 35/30/35 | 75% MEHWK 25% EHWK | 100% NSWK | 0 | 6 |
| 605 | CTEC | 35/30/35 | 75% MEHWK 25% EHWK | 100% NSWK | 0 | 12 |
| 606 | UCTAD | 36/28/36 | 100% EHWK | 100% NSWK | 0 | 6 |
| 607 | UCTAD | 36/28/36 | 100% EHWK | 100% NSWK | 5 kg/MT Prosoft | 6 |
| 608 | UCTAD | 36/28/36 | 100% MEHWK | 100% NSWK | 0 | 6 |
| 609 | UCTAD | 36/28/36 | 100% MEHWK | 100% NSWK | 0 | 12 |

The tissue basesheets produced above were converted into tissue products. For the CTEC tissue basesheets, two layers of the basesheets were attached with the creped side exposed to outer side to form a two-ply facial tissue. For the UCTAD, only a single layer of the basesheet was used to form a one-ply tissue product. Both the converted facial tissue products were subjected to physical testing, the results of which are summarized in Tables 8 and 9, below.

TABLE 8

| Sample | Plies | Basis Weight (gsm) | Caliper (mils) | Sheet Bulk (cc/g) | GMT | Delta Bulk (%) | Delta GMT (%) |
|---|---|---|---|---|---|---|---|
| 601 | 2 | 28.6 | 5.9 | 5.2 | 822 | — | — |
| 604 | 2 | 27.9 | 8.9 | 8.1 | 316 | 56% | −62% |
| 605 | 2 | 27.6 | 7.4 | 6.8 | 557 | 31% | −32% |
| 606 | 1 | 29.7 | 12.0 | 10.3 | 1197 | — | — |
| 607 | 1 | 28.8 | 12.6 | 11.1 | 651 | 8% | −46% |
| 608 | 1 | 28.7 | 15.2 | 13.5 | 626 | 31% | −48% |
| 609 | 1 | 28.8 | 18.0 | 15.9 | 1177 | 54% | −2% |

TABLE 9

| Sample | TS7 | TS750 |
|---|---|---|
| Code 601 | 9.384 | 7.489 |
| Code 602 | 7.851 | 7.576 |
| Code 603 | 6.817 | 5.809 |
| Code 604 | 5.283 | 5.936 |
| Code 605 | 7.71 | 6.656 |

Hydraulically Entangled Nonwoven Web Comprising Modified Pulp Fiber

Modified Northern Softwood Kraft (MNSWK) pulp fiber was prepared by mixing 20 kg of NSWK with 500 kg of 3 wt % NaOH solution for 10 minutes. Excess NaOH solution was removed by centrifugal dehydrator top yield 55 kg of alkali treated pulp. A cyanuric chloride solution was prepared by mixing 1 kg of cyanuric chloride in 600 L acetone. The cyanuric chloride solution was mixed with the 55 kg of alkali treated fiber by agitating at 30° C. for 2 hours. After the reaction was completed, excess acetone was removed by a centrifugal dehydrator and the resulting pulp was washed with 500 kg of water, which was removed by a centrifugal dehydrator. The process of washing with 500 kg of water and centrifugation was repeated three times to yield 50 kg of modified pulp (MNSWK).

A hydraulically entangled nonwoven web was formed by laying a wet pulp sheet onto a spunbond nonwoven and then treated by high pressure water stream for three times with a step-up pressure each pass. Pulp samples were prepared by combining a total of about 25 pounds of wood pulp fibers, diluting to a consistency of about 40% and pulping for 25 minutes at about 70° F.

A hydraulically entangled nonwoven having a basis weight of about 64 gsm was formed by layer; a layer of wet pulp on top of a layer of spunbond nonwoven on a foraminous entangling surface of a conventional hydraulic entangling machine. The layers of pulp fiber and spunbound were entangled by passing the layers under three hydraulic entangling manifolds, which treat the layers with jets of fluid. The entangling machine speed was 45 feet per minute, jet strip was 0.120 and manifold pressures were set at 700 psi ($1^{st}$ pass), 1000 psi ($2^{nd}$ pass) and 1500 psi ($3^{rd}$ pass). Table 10 summarizes the resulting hydraulically entangled nonwoven samples as well as physical properties.

TABLE 10

| | Furnish | | | | |
|---|---|---|---|---|---|
| Sample | SSWK/ NSWK | MNSWK | Abrasion Resistance - Taber Method (cycle) | Caliper (mils) | GMT |
| 1 | 100% | 0% | 30 | 20.1 | 4741 |
| 2 | 75% | 25% | 28 | 20.5 | 4843 |
| 3 | 70% | 30% | 19 | 21.1 | 4158 |
| 4 | 65% | 35% | 18 | 22.3 | 4005 |
| 5 | 60% | 40% | 29 | 21.8 | 4743 |
| 6 | 55% | 45% | 30 | 22.9 | 3919 |
| 7 | 0% | 100% | 8 | 27.4 | 2820 |

We claim:

1. A method of forming a high bulk tissue web comprising the steps of mixing cellulosic fiber and a first organic solvent to form an fiber slurry, adjusting the pH of the fiber slurry with a caustic agent to a pH greater than about 9.0 thereby forming a alkaline fiber slurry; adding a cyanuric halide having general Formula (I) in the presence of a second organic solvent:

(I)

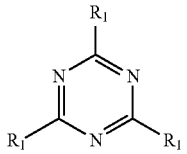

where R=chlorine, bromine, fluorine or iodine to the alkaline fiber slurry thereby forming a modified cellulosic fiber; washing the modified cellulosic fiber; and forming a tissue web from the washed modified cellulosic fiber, wherein the tissue web has a basis weight greater than about 10 grams per square meter (gsm) and a sheet bulk greater than about 6 cc/g.

2. The method of claim 1 wherein the caustic agent is selected from the group consisting hydroxide salts, carbonate salts and alkaline phosphate salts.

3. The method of claim 1 wherein the cyanuric halide is cyanuric chloride.

4. The method of claim 1 wherein the first organic solvent is selected from the group consisting of acetone, DMSO, DMF, acetonitrile, alcohols, polyalcohols, polyalcoholic ethers, pyridine, sulfolane, N-methyl pyrrolidinone and dioxane.

5. The method of claim 1 wherein the alkaline fiber slurry has a fiber consistency from about 5 to about 30 percent solids.

6. The method of claim 1 wherein the weight ratio of cellulosic fiber to cyanuric halide is from about 5:0.1 to about 5:1.

7. The method of claim 1 wherein the step of adding a cyanuric halide is carried out at a pH from about 9 to about 10 and at a temperature from about 0 to about 40° C.

8. The method of claim 1 wherein the cellulose fiber is either bleached northern softwood kraft pulp or bleached eucalyptus kraft pulp.

9. The method of claim 1 wherein the washed modified cellulosic fiber has a nitrogen content of at least about 0.2 weight percent.

* * * * *